US010648181B2

(12) United States Patent
Volponi

(10) Patent No.: US 10,648,181 B2
(45) **Date of Patent: *May 12, 2020**

(54) SYSTEM AND METHOD FOR ALIGNING AND LEVELING TILE

(71) Applicant: New Standards Manufacturing Co., Keokuk, IA (US)

(72) Inventor: Michele Volponi, Keokuk, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/275,958

(22) Filed: Sep. 26, 2016

(65) Prior Publication Data

US 2017/0009465 A1 Jan. 12, 2017

Related U.S. Application Data

(60) Continuation of application No. 14/186,729, filed on Feb. 21, 2014, now Pat. No. 9,945,133, which is a (Continued)

(51) Int. Cl.
*E04F 13/08* (2006.01)
*E04F 21/18* (2006.01)

(Continued)

(52) U.S. Cl.
CPC ..... *E04F 13/0892* (2013.01); *E04F 13/0889* (2013.01); *E04F 15/0215* (2013.01);

(Continued)

(58) Field of Classification Search
CPC . E04B 1/00; E04B 1/003; E04G 21/00; E04F 15/00; E04F 13/0892;

(Continued)

(56) References Cited

U.S. PATENT DOCUMENTS 1,918,228 A 7/1933 Spencer
2,277,892 A 3/1942 Swenson (Continued)

FOREIGN PATENT DOCUMENTS

CA 2847571 A1 * 3/2013 ..... E04F 21/1877
CA 2881270 A1 * 2/2014 ..... E04F 21/0092

(Continued)

OTHER PUBLICATIONS

Kufner et al, The Lippage-Free Tile System, Web (www.tuscanleveling.com), 2006, Fairfield, IA.

*Primary Examiner* — Robert Canfield
(74) *Attorney, Agent, or Firm* — Simmons Perrine Moyer Bergman PLC

(57) ABSTRACT

A tile aligning and leveling system that uses an under tile base re-usable upright connecting tab, which is detachably connected to said under tile base, a re-usable flexible edge slotted cap configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

3 Claims, 5 Drawing Sheets

Related U.S. Application Data division of application No. 14/030,346, filed on Sep. 18, 2013, now Pat. No. 8,689,521, which is a division of application No. 13/855,537, filed on Apr. 2, 2013, now Pat. No. 8,561,370, which is a division of application No. 13/707,369, filed on Dec. 6, 2012, now Pat. No. 8,572,927, which is a division of application No. 13/296,737, filed on Nov. 15, 2011, now Pat. No. 8,429,878.

(51) Int. Cl.
*E04F 21/20* (2006.01)
*E04F 21/00* (2006.01)
*E04F 21/22* (2006.01)
*E04F 15/02* (2006.01)

(52) U.S. Cl.
CPC ..... *E04F 21/0092* (2013.01); *E04F 21/1877* (2013.01); *E04F 21/20* (2013.01); *E04F 21/22* (2013.01); *Y10T 29/53796* (2015.01)

(58) Field of Classification Search
CPC . E04F 13/0889; E04F 15/02; E04F 15/02005; E04F 21/0092; E04F 21/22; E04F 21/20; E04F 15/0215; E04F 21/1877; Y10T 29/53796
USPC .... 52/58, 60, 302.5, 302.6, 631, 716.2, 741, 52/126.5, 749.11; 33/613, 645
See application file for complete search history.

(56) References Cited

U.S. PATENT DOCUMENTS 3,511,001 A * 5/1970 Morgan, Jr. ..... E04F 15/02476 52/126.5
3,861,098 A * 1/1975 Schaub ..... E01C 3/006 52/263
3,961,453 A * 6/1976 Couwenbergs ..... E04D 11/005 52/126.1
4,024,683 A * 5/1977 Kilian ..... E04F 21/0092 52/127.3
4,397,125 A 8/1983 Gusler
4,503,654 A 3/1985 Consentino
4,583,343 A * 4/1986 Camp ..... E04F 13/0862 294/187
4,744,194 A 5/1988 Yasuyoshi
4,862,668 A 9/1989 DeGooyer
5,345,990 A 9/1994 Potts
5,350,399 A 9/1994 Erlebacher et al.
5,603,195 A 2/1997 Consentino
5,675,942 A 10/1997 Crawford
5,843,546 A 12/1998 Eichhorn
6,022,351 A 2/2000 Bremer et al.
6,253,515 B1 7/2001 Kuelker
6,625,951 B1 * 9/2003 McCarthy ..... E04D 11/007 156/297
6,755,834 B2 6/2004 Amis
7,257,926 B1 * 8/2007 Kirby ..... E04F 21/0092 33/526
D552,266 S 10/2007 Murdock
7,621,100 B2 11/2009 Kufner et al.
D621,966 S 8/2010 Vaes
D630,077 S 1/2011 Kufner et al.
D630,078 S 1/2011 Kufner et al.
7,861,487 B2 * 1/2011 Kufner ..... E04F 21/0092 33/526
7,946,093 B1 * 5/2011 Sturino ..... E04F 21/0092 33/527
D640,119 S 6/2011 Kufner et al.
7,954,300 B1 * 6/2011 Kufner et al. ..... E04F 21/22 33/526
7,992,354 B2 8/2011 Doda
8,079,199 B1 12/2011 Kufner et al.
D658,963 S 5/2012 Kufner et al.
8,181,420 B2 * 5/2012 Torrents I Comas ..... E04F 21/0092 52/127.7
8,241,342 B2 8/2012 Kirschman
8,429,787 B2 4/2013 Maynard et al.
8,429,878 B1 4/2013 Hoffman et al.
8,429,879 B1 4/2013 Hoffman et al.
8,607,468 B2 * 12/2013 Hillebrandt ..... E04F 15/02005 33/527
8,628,049 B2 * 1/2014 Ghatikar ..... E04L 39/18 248/201
8,800,246 B2 * 8/2014 Gorton ..... E04F 21/0092 52/747.11
9,010,064 B1 4/2015 Farahmandpour
9,027,308 B2 5/2015 Kufner et al.
9,045,911 B2 6/2015 Hoffman et al.
9,149,276 B2 10/2015 Voss
9,228,363 B2 1/2016 Kufner et al.
9,279,259 B1 3/2016 Russo
9,322,185 B1 4/2016 Russo
9,353,515 B2 5/2016 Farahmandpour
9,433,438 B2 9/2016 Memmolo et al.
9,464,448 B2 10/2016 Hoffman et al.
10,161,145 B2 * 12/2018 Lazaro Florensa ..... E04F 15/02
2003/0229349 A1 12/2003 Wellisz et al.
2006/0185269 A1 8/2006 Kufner et al.
2006/0185319 A1 8/2006 Kufner et al.
2007/0214743 A1 9/2007 Alvarez
2008/0141617 A1 6/2008 Joski
2008/0236094 A1 10/2008 Doda
2008/0275511 A1 11/2008 Weinacker et al.
2010/0263304 A1 10/2010 Comas
2010/0287868 A1 11/2010 Kufner et al.
2011/0011031 A1 1/2011 Kufner et al.
2011/0265424 A1 11/2011 Kufner et al.
2012/0085066 A1 4/2012 Kufner et al.
2012/0144773 A1 6/2012 Bondielli
2013/0055675 A1 3/2013 Sighinolfi
2013/0067854 A1 3/2013 Bordin
2013/0074425 A1 3/2013 Miyamoto
2013/0247508 A1 9/2013 Hoffman et al.
2013/0255182 A1 10/2013 Kufner et al.
2014/0116001 A1 5/2014 Ghelfi
2014/0283401 A1 9/2014 Kufner et al.
2014/0298736 A1 * 10/2014 Bunch ..... E04F 21/0092 52/126.1
2014/0325935 A1 11/2014 Hoffman et al.
2014/0325936 A1 * 11/2014 Psaila ..... E04F 21/1877 52/749.11
2015/0027082 A1 1/2015 Hoffman et al.
2015/0113895 A1 * 4/2015 Zinssler ..... E04F 13/0803 52/309.3
2015/0211243 A1 7/2015 Irvine et al.
2015/0308130 A1 10/2015 Biec
2016/0053501 A1 2/2016 Comas
2016/0348381 A1 12/2016 Meyers
2018/0291640 A1 * 10/2018 Sighinolfi ..... E04F 21/20

FOREIGN PATENT DOCUMENTS

CA 3013641 A1 * 8/2017 ..... E04F 21/20
DE 2301169 A1 * 7/1974 ..... E04F 13/14
GB 2460429 A * 12/2009 ..... E04F 21/1844
JP 07-305494 A 11/1995
KR PCT/US2012/055482 5/2013

* cited by examiner

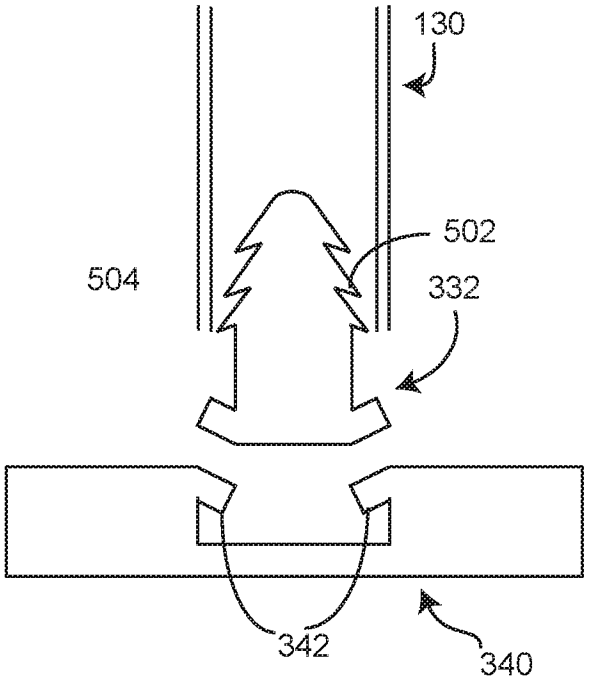
FIG. 6
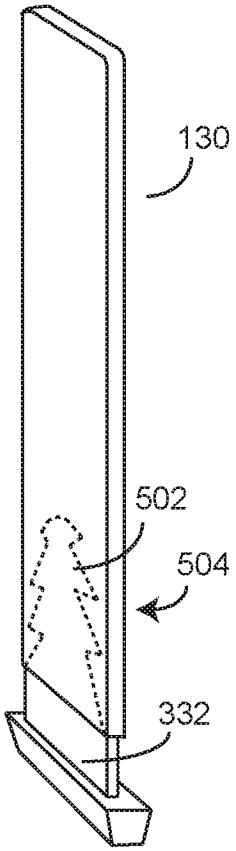
FIG. 5
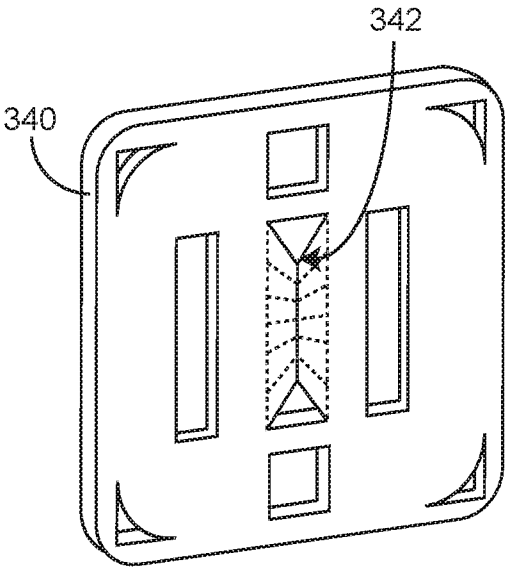

SYSTEM AND METHOD FOR ALIGNING AND LEVELING TILE

CROSS-REFERENCE TO RELATED APPLICATION

This application claims the benefit of the filing date of the non-provisional patent application with the same title and filed by the same inventors on Feb. 21, 2014, and having Ser. No. 14/186,729; which patent application was a divisional of the issued patent with the same title and by the same inventors with the issued date of Apr. 8, 2014 and having U.S. Pat. No. 8,689,521; which issued patent was a divisional of the issued patent with the same title and by the same inventors with the issued date of Oct. 22, 2013 and having U.S. Pat. No. 8,561,370; which issued patent was a divisional of the issued patent with the same title and by the same inventors with the issued date of Nov. 5, 2013 and having U.S. Pat. No. 8,572,927; and which issued patent was a divisional of the issued patent with the same title and by the same inventors with the issued date of Apr. 30, 2013 and having U.S. Pat. No. 8,429,878, which patents are incorporated herein by reference in their entirety.

BACKGROUND OF THE INVENTION

This invention relates to systems and methods for laying tile and, more specifically, for efficiently reducing tile lippage. Throughout this description, the term tile is used as an example of various matter which is arranged disposed adjacent a substrate (which can be horizontal—floors or vertical—walls or other) in multiple pieces, the term tile should be understood to include panels, sheets, boards, paving stones, bricks or the like. The present invention relates more specifically to improved methods and systems which use tab systems to align and level tiles.

U.S. Pat. No. 7,861,487 and U.S. Design Pat. D63077 and the web site www.tuscanleveling.com describe a system for aligning and leveling tiles. While such systems have enjoyed some success in the past, they do have drawbacks. At the conclusion of each job, the vertical shafts extending upwardly between the tile joints in such design are broken away from the base and discarded. This generates waste that may be disposed in landfills. In addition, the act of breaking away the shaft from the base can be time consuming, and it can disturb the tiles if it is not done properly or if the tile is not sufficiently adhering to desired substrate.

Consequently, there is a need for improvement in tile aligning and leveling systems and methods.

SUMMARY OF THE INVENTION

More specifically, an object of the invention is to provide a cost effective tile aligning system.

It is a feature of the present invention to include reusable connecting tabs or shafts.

It is an advantage of the present invention to decrease the materials that are consumed or disposed of for each job.

It is another feature of the invention to include a cap system that is detachable from the tab or shaft, while it remains in place attached to the base located under the tile.

It is also an advantage of the present invention to provide improved ease of use and reduce unwanted dislocation of tiles after desired placement is accomplished.

It is another feature of the present invention to change how pressure is applied to the surface of the tile and the connecting tab.

It is another advantage of the present invention to provide for the ability to maintain lippage reducing forces over a wider range of tab or shaft elongation.

The present invention includes the above-described features and achieves the aforementioned objects.

Accordingly, the present invention comprises a tile leveling system with a reusable connecting tab; a cap which is easily removable from an attached connecting tab or shaft; or a spring like cap which provides for variable forces between the cap and the tile without any change in the separation between base and the tile.

BRIEF DESCRIPTION OF THE DRAWINGS

In the following description of the drawings, in which like reference numerals are employed to indicate like parts in the various views:

FIG. 5 shows a perspective exploded view of the tab and base combination of the present invention, where the dotted lines show underlying structure which would otherwise not be visible.

FIG. 6 shows a cross section exploded view of the tab and base combination of FIG. 5.

DETAILED DESCRIPTION OF THE DRAWINGS

Figure 1:
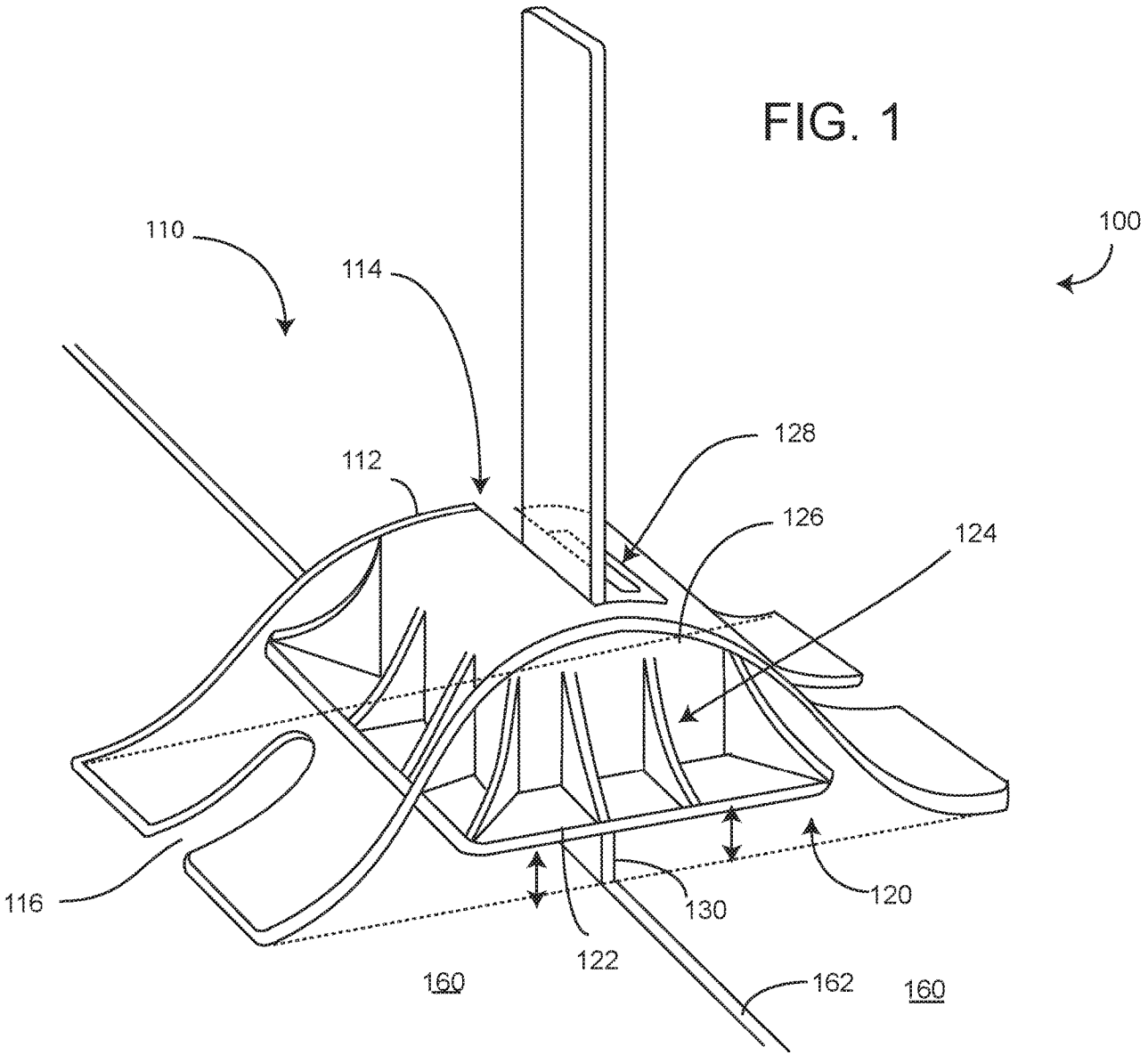
FIG. 1 is a perspective, partially transparent, view of the tile alignment and leveling system of the present invention, in its intended environment when a relatively low pressure is applied.
Figure 2:
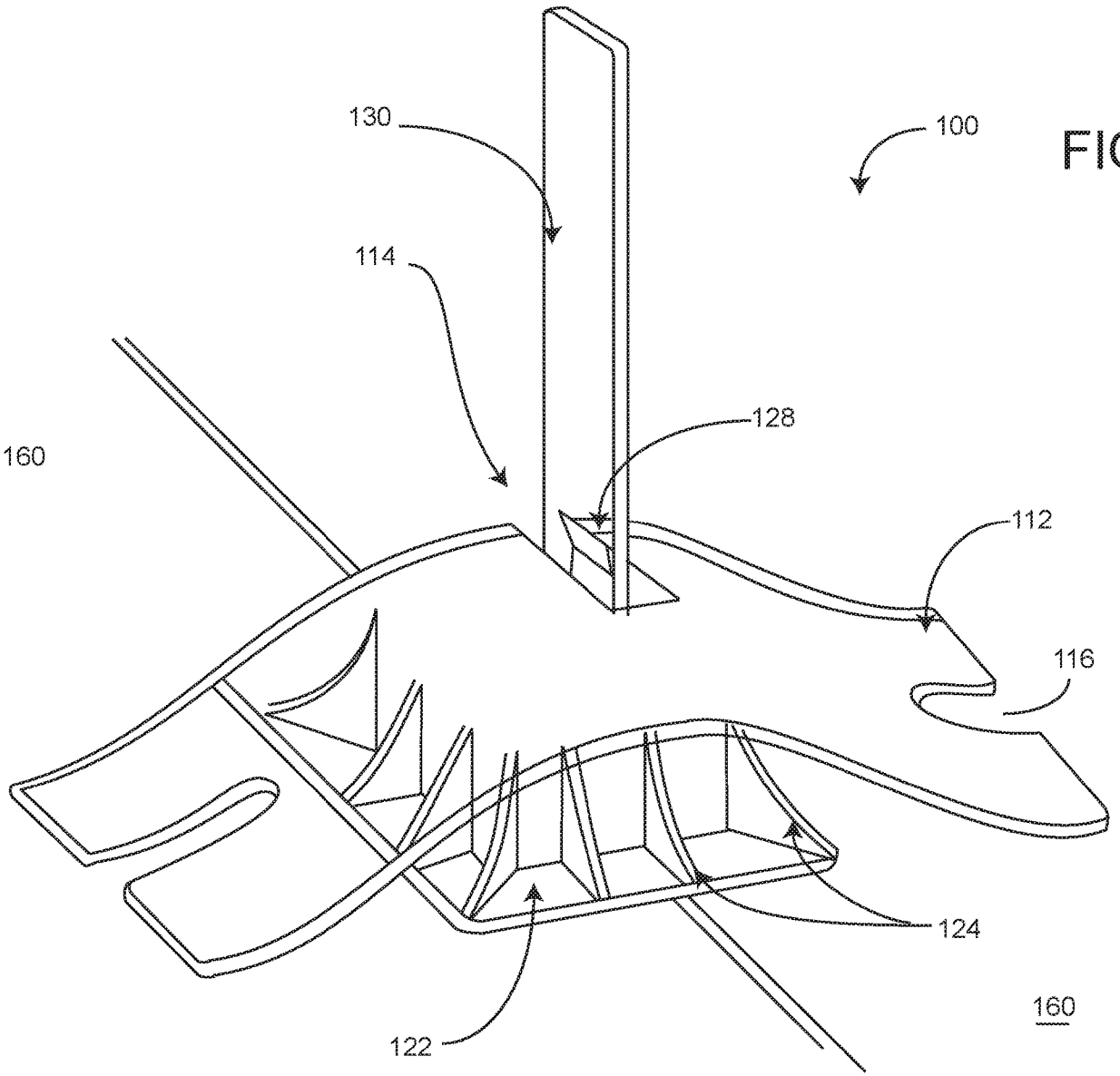
FIG. 2 is a perspective, partially transparent, view of the tile alignment and leveling system of FIG. 1, when a relatively higher pressure is applied.
Figure 3:
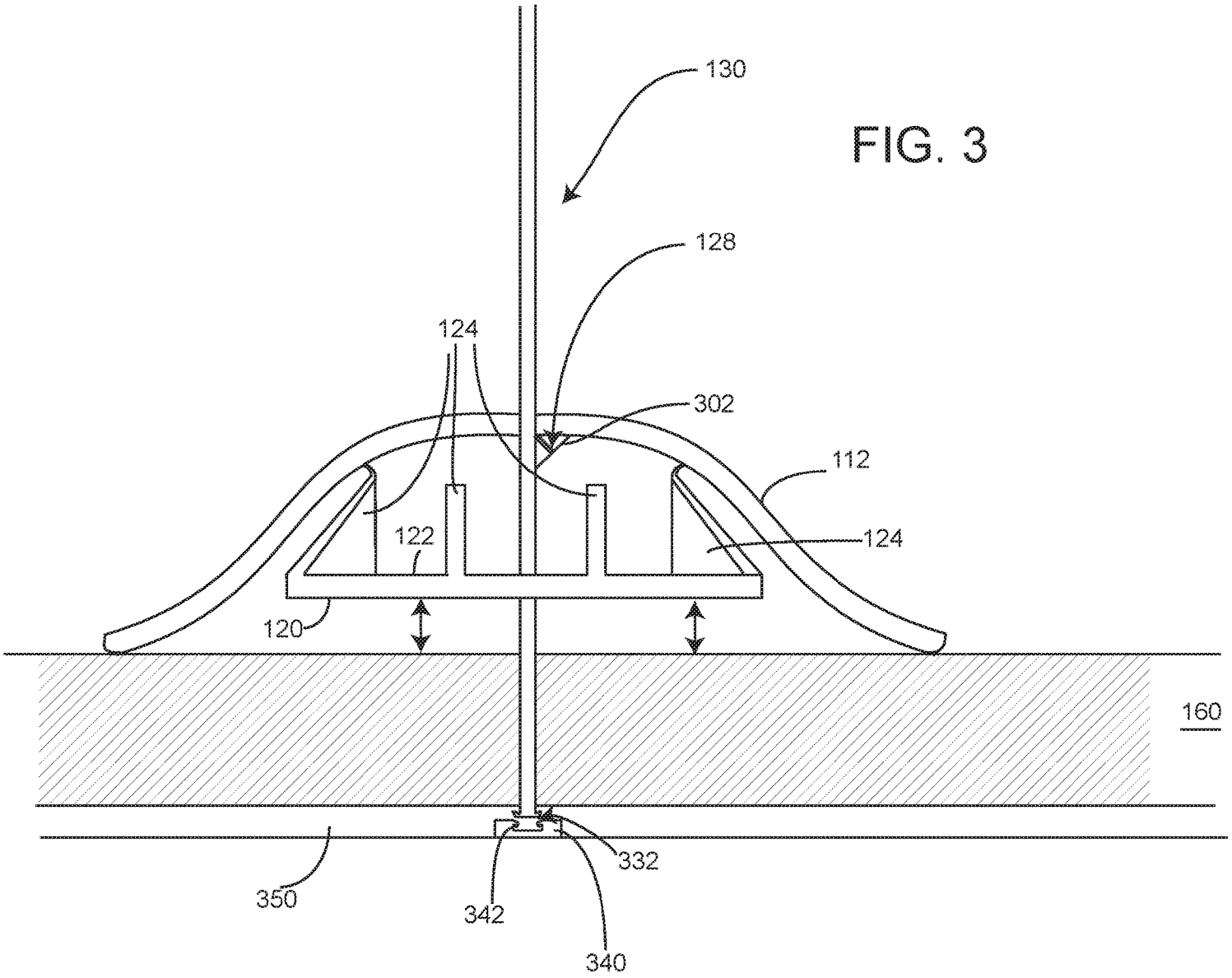
FIG. 3 shows a cross-sectional view of portions of the system as shown in FIG. 1.

Referring now to the drawings, where like numerals refer to like matter throughout, and more particularly to FIG. 1, there is shown a tile alignment and leveling system 100 which generally includes a cap system 110 and a connecting tab 130 which is disposed on the finished side of an array of tiles 160, with a joint 162 therebetween. Cap system 110 is shown having an upper cap spring-like portion 112 and a cap base portion 120. These may be a single piece or multiple pieces of the same or dissimilar material. Upper cap spring-like portion 112 needs to be resilient so as to act like a spring when compressed, downward toward the tile. Note that upper cap spring-like portion 112 is shown in FIGS. 1 and 2 as being partially transparent so that the details of cap base portion 120 can be seen. Cap base portion 120 need not be as resilient but may be if so desired. Cap system 110 and connecting tab 130 may be made of similar materials as prior art systems such as described in the above referenced patent. However, connecting tab 130 may be made of metal or plastic or rubber coated metal. Upper cap spring-like portion 112 includes an innovative edge tab removal slot 114 which allows for separation of the connecting tab 130 from the cap system 110 while the connecting tab 130 remains coupled to the sub tile base member 340 (FIG. 3). When cap system 110 is moved away, (e.g. slid in one direction) the connecting tab 130 passes through the edge tab removal slot 114 and detachment occurs while connecting tab 130 remains in place. Note this can occur in the configuration of FIG. 1 or FIG. 2. It is not necessary to tip the cap system 110 and thereby increase the pressure at the pivot point and increase the potential for unwanted and potentially disruptive forces on the tile. Cap system 110 can be merely slid out of the way and the connecting tab 130 then can be detached without increasing any pressure on the top surface of the tile. Upper cap spring-like portion 112 also has an optional slot 116. Disposed underneath the upper cap spring-like portion 112 is cap base portion 120 which provides increased surface area for contact between the cap system 110 and the tile. Cap base buttress 124 provides support for the cap base portion core 126 which is located centrally in cap base portion 120. Also located in cap system 110 is gripping tongue 128 which is configured to firmly grip the connecting tab 130. Note that connecting tab 130 does not necessarily require that there be surface features thereon in order to properly function.

One advantage of the present invention over the system of the above referenced patent is that the upper cap spring-like portion 112 acts like a spring which can provide a force which tends to hold adjacent tile in the same relative position, despite a stretching or thermal expansion of said connecting tab 130. Note, in the above referenced patent, if the shaft were to become elongated (even in some cases by a very small amount) as a result of stretching or thermal expansion; then the force applied by the cap onto the adjacent tiles could be completely eliminated. The spring-like nature of the upper cap spring-like portion 112 makes it much less likely that enough elongation will occur to eliminate contact. In other words, it is not as likely that the elongation will be sufficient to overcome the amount of deflection of the upper cap spring-like portion 112.

Now referring to FIG. 2, there is shown a tile alignment and leveling system 100 of FIG. 1 which has been pressed downward so that the cap base flange 122 now touches the tile top surface. It can be seen that the contact surface between the cap system 110 and the tile includes both the points of contact between the upper cap spring-like portion 112 and the cap base flange 122. This area of contact can be several times the area of similar contact in the above described patent.

Now referring to FIG. 3, there is shown the cross-sectional view of the tile alignment and leveling system 100 of FIG. 1. Also shown is gripping tongue support member 302 which is shown as being coupled to the upper cap spring-like portion 112. Note, that when upper cap spring-like portion 112 is pressed downward as in FIGS. 2 and 4 there is deflection of upper cap spring-like portion 112 and therefore relative movement of gripping tongue support member 302/gripping tongue 128 mounted thereon with respect to the connecting tab 130. Also shown in FIG. 3 is the substrate mortar 350 and sub tile base member 340 which is placed in the mortar or against the substrate. Sub tile base member 340 is shown having base mating portion 342 for temporarily grasping the connecting tab base mating member 332 disposed on connecting tab 130. Note, that the base mating portion 342 is designed to release the connecting tab base mating member 332 or otherwise disengage contact with the connecting tab 130 when a requisite force or series of forces is applied thereto. In one embodiment, connecting tab base mating member 332 is a portion of a reusable connecting tab that is removed from the sub tile base member 340 on one job and used again and again on other jobs. In such a configuration only the sub tile base member 340 is a consumable or non-reusable portion of the system. Note: connecting tab base mating member 332 is shown in an enlarged or exaggerated manner for clarity in FIGS. 3 and 4. FIGS. 5 and 6 show embodiments where the widest portion of connecting tab base mating member 332 is not any wider than the widest portion of the remainder of connecting tab 130, this allows for removal of the connecting tab 130 with connecting tab base mating member 332 through the joint in the tile without the need to remove any additional mortar.

Figure 4:
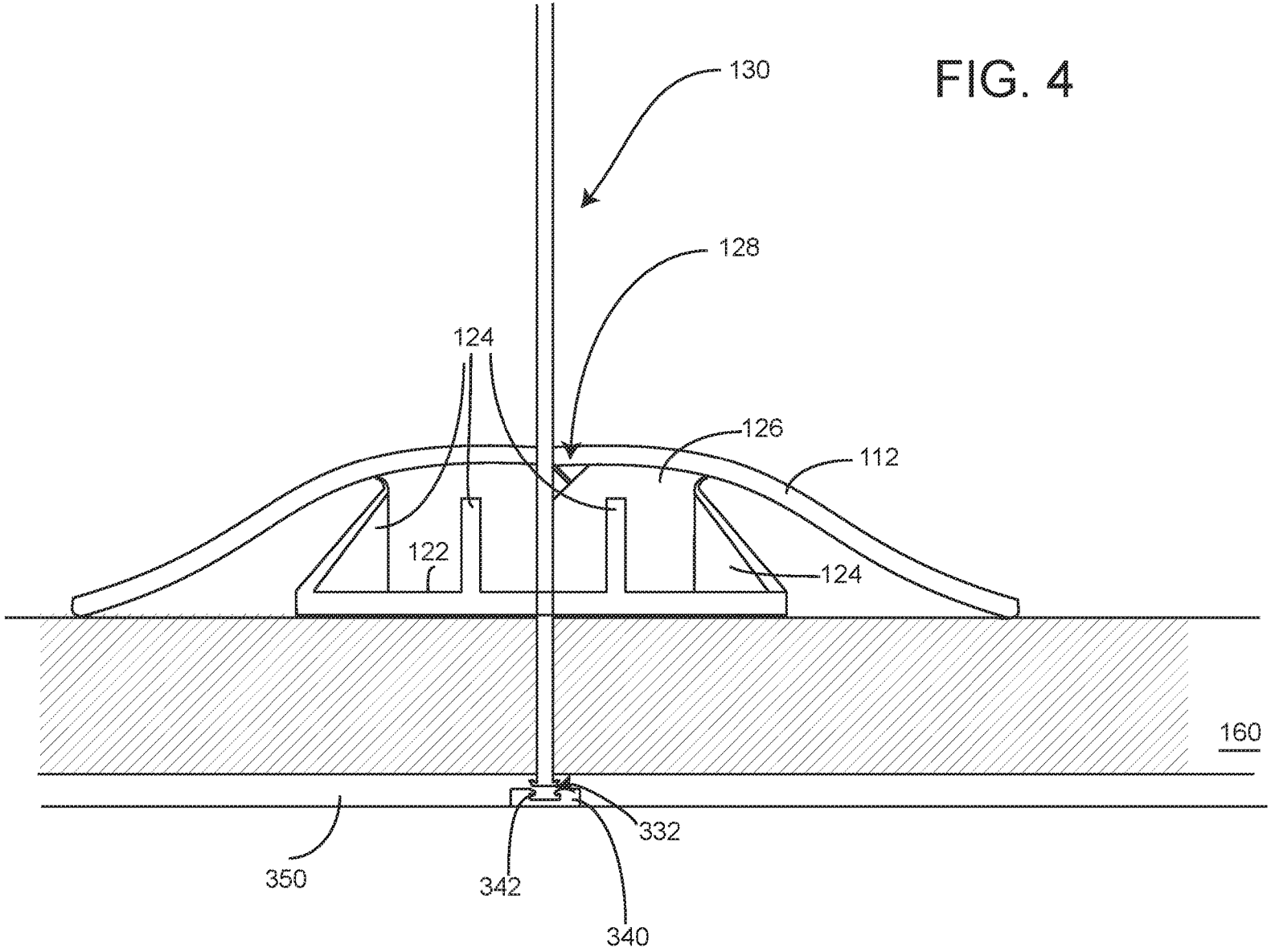
FIG. 4 shows a cross-sectional view of portions of the system as shown in FIG. 2.

Now referring to FIG. 4, there is shown a cross-sectional representation of the tile alignment and leveling system 100 of FIG. 2, which shows the cap base portion 120 touching the tile 160 and the upper cap spring-like portion 112 spread out further. After the initial contact between cap base flange 122 and tile 160 is fully made, the upper cap spring-like portion 112 is configured to apply a variable force between the cap base flange 122 and tile 160 by deflection of the upper cap spring-like portion 112 and without and movement of the cap base portion 120 or the tile 160.

Now referring to FIG. 5, there is shown an exploded perspective view of the connecting tab 130 and sub tile base member 340 combination of the present invention. Sub tile base member 340 is shown having base mating portion 342 which is designed to temporarily grip connecting tab base mating member 332 and then release when the requisite forces are applied. Connecting tab 130 is shown having a connecting tab base mating member 332 which may be a separate metal piece inserted into a connecting tab end opening 504 so that connecting tab mating member internal gripping teeth 502 (shown in dotted lines) hold the connecting tab base mating member 332 in place with respect to the connecting tab 130.

Now referring to FIG. 6, there is shown an exploded cross-sectional view of the connecting tab 130 and sub tile base member 340 combination of the present invention.

In operation, the system of the present invention utilizes the following method:

The reusable connecting tab 130 is coupled to the sub tile base member 340. The system is used to align and level tile in a manner similar to the system described in the above referenced patent, except for the flexing of upper cap spring-like portion 112 after the cap base flange 122 contacts the tile.

In the present invention the upper cap spring-like portion 112 may be, but is not necessarily, compressed and deflected when pressed toward the tile 160. This additional compression of cap system 110 after contact between the cap base flange 122 and the tile provides the force retaining feature to avoid problems associated with undesired elongation of the connecting tab 130.

At the desired time, (e.g. after the mortar is set) the cap system 110 can be removed from the surface of the tile 160 without tipping the cap system 110 and temporarily increasing the forces between the cap and the tile. Instead, the cap system 110 is merely slid away from the connecting tab 130 while the connecting tab 130 remains coupled to the sub tile base member 340. After the cap system 110 has been separated from the connecting tab 130, the re-usable connecting tab 130 is removed from the sub tile base member 340 without the need for increasing downward pressure on portions of the top surface of the tile 160.

The process is repeated for all of the connecting tab 130 and cap system 110 combinations utilized for the job and the re-useable connecting tabs 130 are cleaned and stored for future re-use.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

I claim:

1. A tile alignment system comprising:

a bottom plate, configured to be placed on a back side of a plurality of adjacent structures;

a removable and reusable connecting tab operatively coupled with said bottom plate and sized with a thickness dimension and a width dimension so as to extend through a joint existing between two of said plurality of adjacent structures;

said removable and reusable connecting tab further configured to operatively cooperate with matter configured to maintain pressure to a front side of said plurality of adjacent structures, where said front side is opposite said back side; said pressure assists in reducing lippage between said plurality of adjacent structures;

said bottom plate configured with rectangular shaped void therein for receiving therein a mating member of said removable and reusable connecting tab, said mating member is smaller than said rectangular shaped void;

said bottom plate further comprising a mating portion disposed within said rectangular shaped void and is configured to provide a force resisting removal of said mating member;

wherein said mating portion is configured to release said mating member, where said mating portion, which initially are downwardly directed and when a removal force is applied thereto, is configured to deflect upwardly and thereby reduce said force resisting removal of said mating member;

wherein said removal force is provided by pulling along a longitudinal axis of said removable and reusable connecting tab;

wherein said bottom plate is a non-reusable sub-tile base member; and said mating portion, is configured to release said mating member.

2. A tile alignment system comprising:

an intermediate member for transmitting a force between a back side of a plurality of adjacent tiles and a portion of a front side, which is an opposite side from said back side;

a plate which is configured to be placed on said back side of said plurality of adjacent tiles; and said plate being separate from and configured to receive and retain said intermediate member and to reduce forces resisting removal of said intermediate member when forces aligned with a longitudinal axis of said intermediate member are applied to said plate.

3. The system of claim 2 where said plate comprises a mating portion configured to mate with a metal mating member which is coupled to said intermediate member.

* * * * *